US009677464B2

(12) United States Patent
Durrett et al.

(10) Patent No.: US 9,677,464 B2
(45) Date of Patent: Jun. 13, 2017

(54) SINGLE-SHAFT DUAL EXPANSION INTERNAL COMBUSTION ENGINE

(71) Applicants: GM GLOBAL TECHNOLOGY OPERATIONS LLC, Detroit, MI (US); The Regents of the University of Michigan, Ann Arbor, MI (US)

(72) Inventors: Russell P. Durrett, Bloomfield Hills, MI (US); Paul M. Najt, Bloomfield Hills, MI (US); Peter P. Andruskiewicz, Ann Arbor, MI (US); Elliott Ortiz-Soto, Ann Arbor, MI (US)

(73) Assignees: GM Global Technology Operations LLC, Detroit, MI (US); The Regents of the University of Michigan, Ann Arbor, MI (US)

( * ) Notice: Subject to any disclaimer, the term of this patent is extended or adjusted under 35 U.S.C. 154(b) by 189 days.

(21) Appl. No.: 14/737,621

(22) Filed: Jun. 12, 2015

(65) Prior Publication Data

US 2016/0363045 A1 Dec. 15, 2016

(51) Int. Cl.

| | |
|---|---|
| ***F02B 75/18*** | (2006.01) |
| ***F02B 41/06*** | (2006.01) |
| ***F01B 9/02*** | (2006.01) |
| ***F01L 1/34*** | (2006.01) |

(52) U.S. Cl.

CPC ..... *F02B 41/06* (2013.01); *F01B 9/02* (2013.01); *F01L 1/34* (2013.01); *F02B 75/18* (2013.01); *F02B 2075/1812* (2013.01)

(58) Field of Classification Search

CPC .. F02B 41/06; F02B 75/18; F02B 2075/1812; F02B 37/10; F02B 75/228; F23G 5/46; F23G 7/066

USPC ..... 123/52.1

See application file for complete search history.

(56) References Cited

U.S. PATENT DOCUMENTS

| | | | | |
|---|---|---|---|---|
| 5,857,388 | A | 1/1999 | Killion et al. | |
| 6,237,442 | B1 | 5/2001 | Killion | |
| 8,468,995 | B2 | 6/2013 | Jacques et al. | |
| 8,813,695 | B2 * | 8/2014 | Meldolesi | F02B 21/00 123/52.1 |
| 9,080,508 | B2 * | 7/2015 | Durrett | F02B 41/08 |
| 2003/0013534 | A1 | 1/2003 | Killion et al. | |
| 2010/0050992 | A1 * | 3/2010 | Nakanishi | F02D 15/02 123/48 B |
| 2010/0180868 | A1 * | 7/2010 | Scalzo | F02B 75/048 123/48 B |

(Continued)

*Primary Examiner* — Marguerite McMahon
*Assistant Examiner* — James Kim
(74) *Attorney, Agent, or Firm* — Quinn IP Law

(57) ABSTRACT

A single-shaft dual expansion internal combustion engine includes an engine block, a cylinder head, a single crankshaft, a control shaft and first, second and third multi-link connecting rod assemblies. First and second power cylinders and an expander cylinder are formed in the engine block. First and second power pistons are moveable in the first and second power cylinders and are connected to respective first and second crankpins of the crankshaft. An expander piston is moveable in the expander cylinder and is connected to a third crankpin of the crankshaft. First and second multi-link connecting rod assemblies are coupled to first and second swing arms of the control shaft. A third multi-link connecting rod assembly is coupled to a third swing arm of the control shaft.

20 Claims, 4 Drawing Sheets

(56) References Cited

U.S. PATENT DOCUMENTS

2010/0300385 A1* 12/2010 Durrett ..... F02B 41/06
123/64

* cited by examiner

SINGLE-SHAFT DUAL EXPANSION INTERNAL COMBUSTION ENGINE

TECHNICAL FIELD

The present teachings generally include an internal combustion engine assembly.

BACKGROUND

Internal combustion engines combust mixtures of air and fuel to generate mechanical power for work. The basic components of an internal combustion engine are well known in the art and preferably include an engine block, cylinder head, cylinders, pistons, valves, crankshaft and one or more camshafts. The cylinder heads, cylinders and tops of the pistons typically form variable volume combustion chambers into which fuel and air are introduced and combustion occurs as part of a thermodynamic cycle of the device. In all internal combustion engines, useful work is generated from the hot, gaseous products of combustion acting directly on moveable engine components, such as the top or crown of a piston. Generally, reciprocating motion of the pistons is transferred to rotary motion of a crankshaft via connecting rods. One known internal combustion engine operates in a four-stroke combustion cycle, wherein a stroke is defined as a complete movement of a piston from a top-dead-center (TDC) position to a bottom-dead-center (BDC) position or vice versa, and the strokes include intake, compression, power and exhaust. Accordingly, a four-stroke engine is defined herein to be an engine that requires four complete strokes of a piston for every power stroke of a cylinder charge, i.e., for every stroke that delivers power to a crankshaft.

The overall efficiency of an internal combustion engine is dependent on its ability to maximize the efficiency of all the processes by minimizing the compromises that lead to energy losses to the environment. Dividing the traditional four-stroke cycle amongst dedicated components allows the compression process to be made more efficient by attempting to approximate isothermal compression of a cylinder charge through mid-compression heat extraction, such as by using a heat exchanger. Likewise, a greater amount of energy may be harnessed during expansion of a cylinder charge by moving towards an adiabatic expansion, and extending that expansion further to bring the working gases down to atmospheric pressure. In addition, maximizing the ratio of specific heats of the working gas while reducing each specific heat individually allows greater energy extraction over the expansion while minimizing the mechanical and flow losses associated with each dedicated component.

One known approach to meeting these challenges is a low temperature combustion (LTC) turbocharged diesel engine. The LTC turbocharged diesel relies on a two-stage compression process separated by charge cooling to approximate isothermal compression, reducing the work required to achieve a given air density, lean low temperature combustion to minimize heat losses while improving gas properties, and a two-stage expansion process to enhance work recovery from the hot post-combustion gases. Thermodynamically, the turbocharged diesel is a multi-shaft dual-compression, dual expansion engine that relies on a combination of rotating and reciprocating machines to execute two compressions prior to combustion and two expansions post-combustion. However, the overall efficiency may be limited by the ability to match and optimize the performance of these components over the operating domain. Air handling systems used to provide boosting on externally-charged multi-shaft engines may include more complex boosting systems using two and three stages of turbocharging or combinations of turbochargers and mechanically driven superchargers. In addition to the charging devices, the systems require heat exchangers, bypass valves and controls.

SUMMARY

A single-shaft dual expansion internal combustion engine is described and includes an engine block, a cylinder head, a single crankshaft, a control shaft and first, second and third multi-link connecting rod assemblies. First and second power cylinders and an expander cylinder are formed in the engine block. The first and second power pistons are moveable in the first and second power cylinders, respectively, and are connected via the respective first and second multi-link connecting rod assemblies to respective first and second crankpins of the crankshaft. An expander piston is moveable in the expander cylinder and is connected via the third multi-link connecting rod assembly to a third crankpin of the crankshaft. The first and second multi-link connecting rod assemblies are coupled to fourth pivot pins of respective first and second swing arms that are attached to the control shaft, and the third multi-link connecting rod assembly is attached to a fifth pivot pin of a third swing arm that is attached to the control shaft. The third swing arm attaches to the control shaft at a position that is rotated 180 degrees about a rotational axis of the control shaft from an attaching location of the first and second swing arms.

The above features and advantages and other features and advantages of the present teachings are readily apparent from the following detailed description of the best modes for carrying out the present teachings when taken in connection with the accompanying drawings.

DETAILED DESCRIPTION

Figure 1:
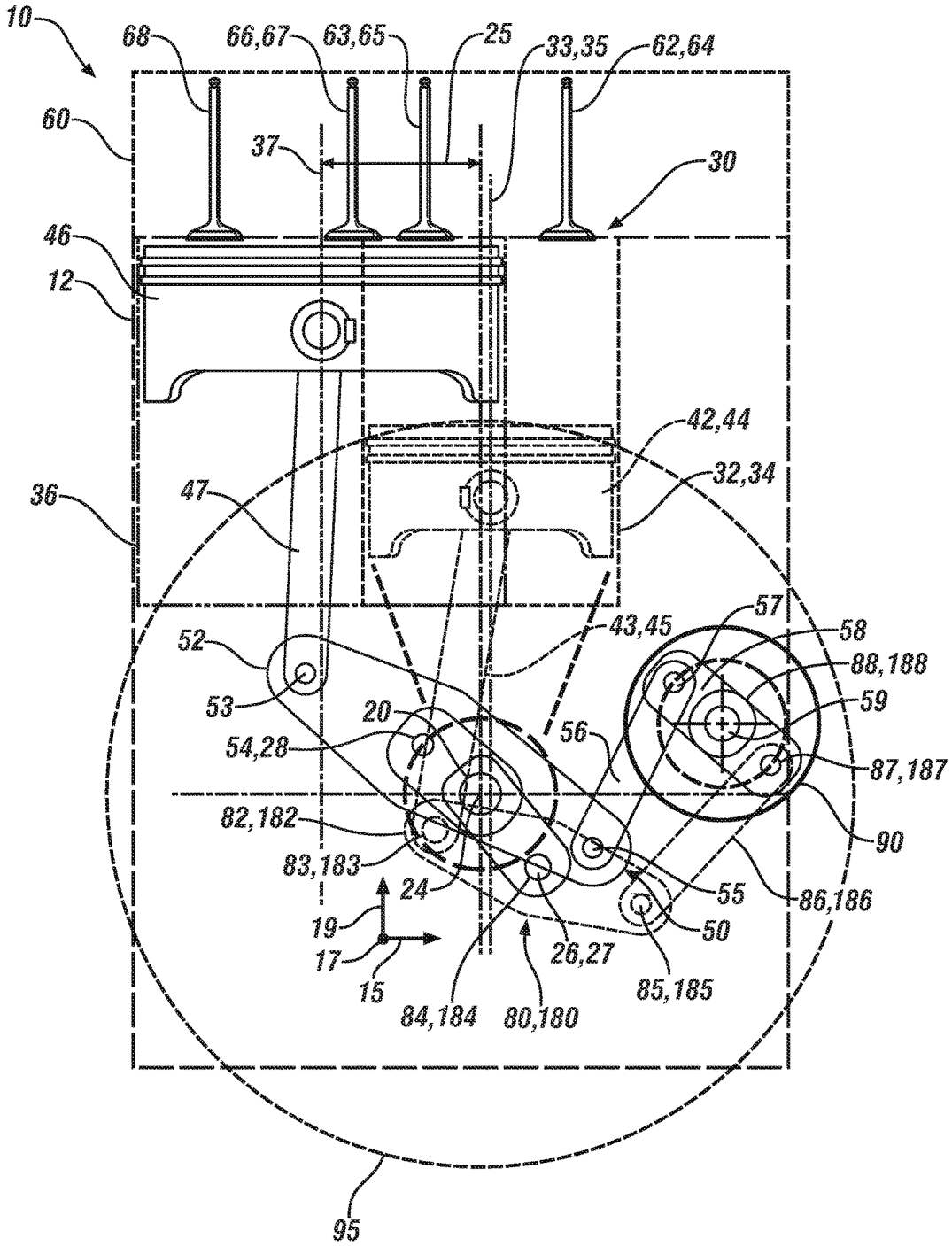
FIG. 1 schematically illustrates an end view of one embodiment of a single-shaft dual expansion internal combustion engine, in accordance with the disclosure.
Figure 2:
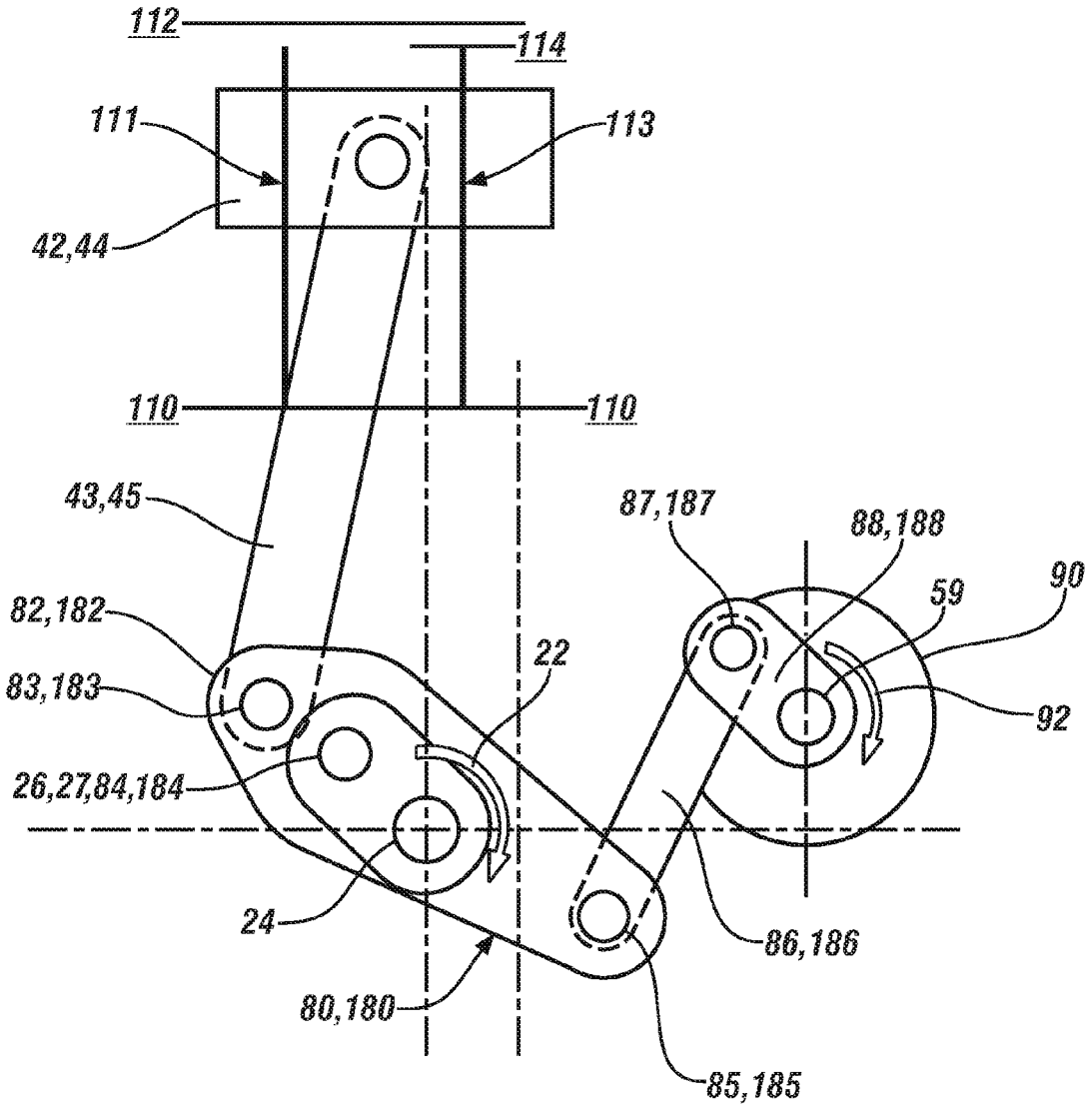
FIGS. 2 and 3 schematically illustrate partial end views of the embodiment of a single-shaft dual expansion internal combustion engine, in accordance with the disclosure.
Figure 3:
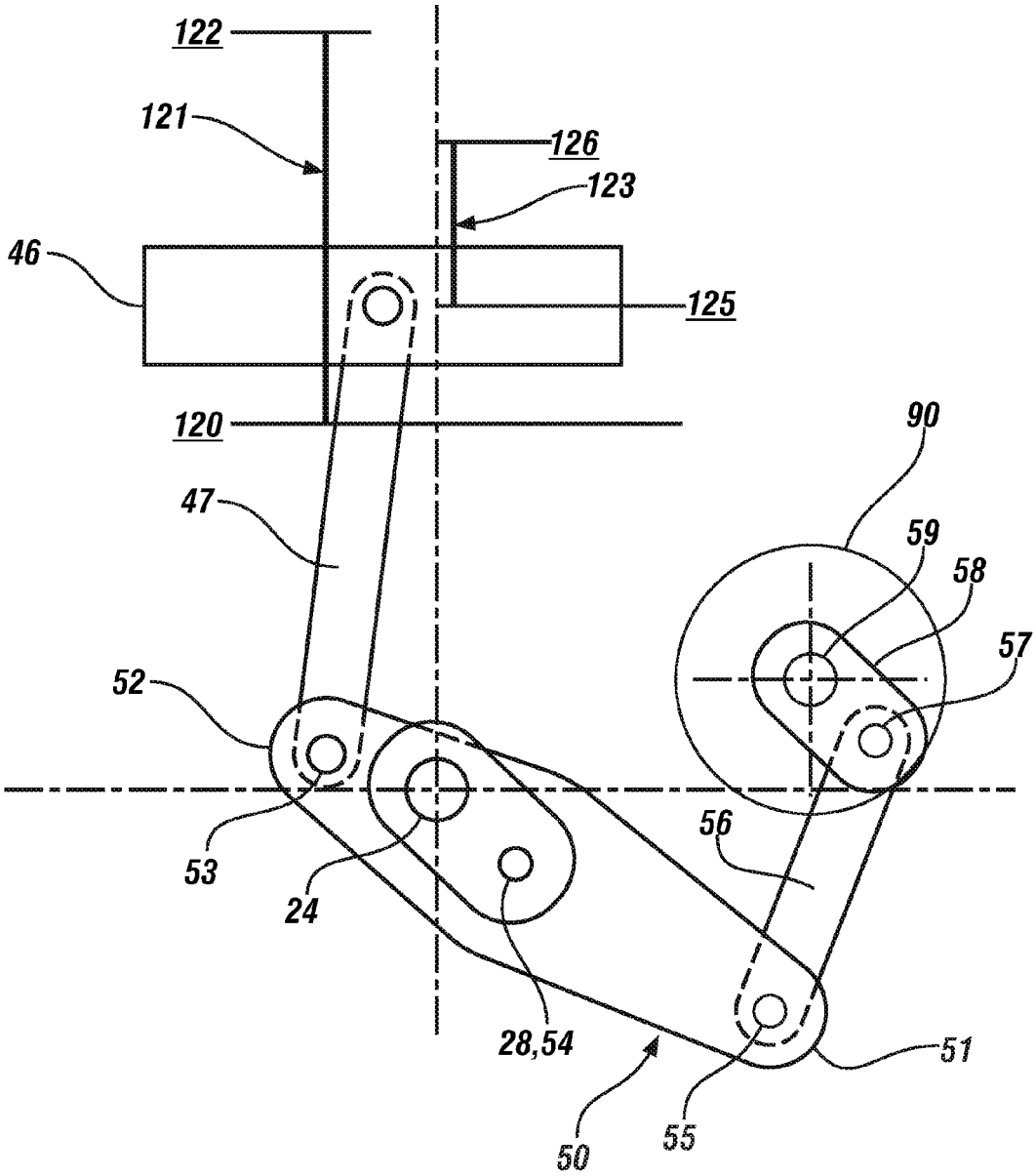
Figure 4:
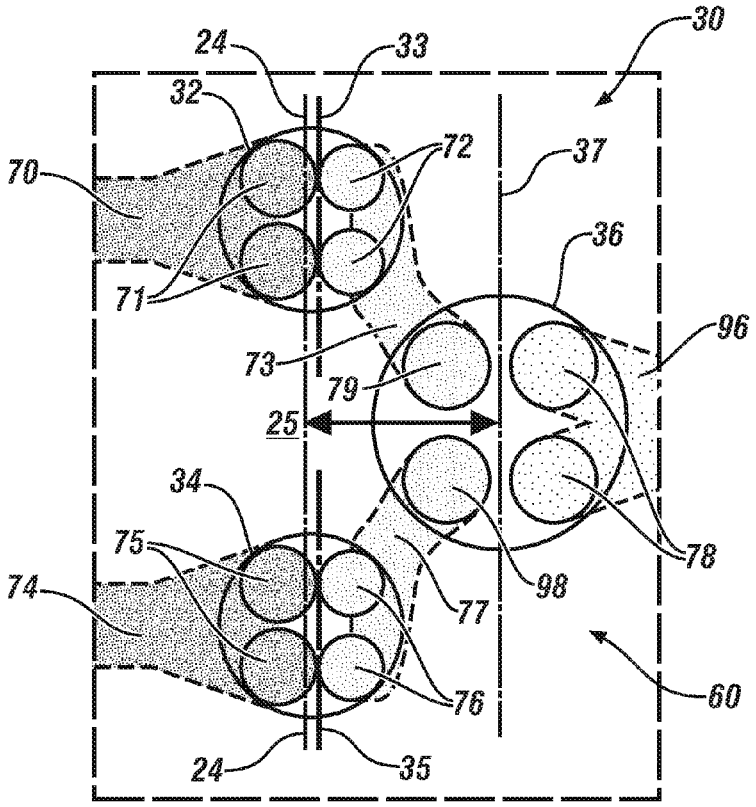
FIG. 4 schematically illustrates a top view of a portion of the embodiment of the single-shaft dual expansion internal combustion engine, in accordance with the disclosure.

Referring to the drawings, wherein like reference numbers are used to identify like or identical components in the various views, FIG. 1 schematically illustrates an end view of one embodiment of a single-shaft dual expansion internal combustion engine (engine) 10, FIGS. 2 and 3 schematically illustrate partial end views of the embodiment of the engine 10, and FIG. 4 schematically illustrates a top view of a portion of the embodiment of the engine 10 in accordance with this disclosure. Like numerals indicate like elements throughout the various Figures.

The engine 10 includes an engine block 12 that includes a compound cylinder configuration including cylinder triplets 30 as described herein, a crankshaft main bearing mount for a crankshaft 20 and a cylinder head 60. Although only one cylinder triplet 30 is shown, the engine block 12 may include a plurality of cylinder triplets 30. The physical description is made with reference to a three-dimensional axis including a lateral axis 15, a longitudinal axis 17 and a vertical axis 19, with the longitudinal axis 17 defined by a crankshaft center line 24 of the crankshaft 20, the vertical axis 19 defined by parallel longitudinal axes of engine cylinders 32, 34, 36 composing one of the cylinder triplets 30 and the lateral axis 15 defined as being orthogonal to the longitudinal axis 17 and the vertical axis 19. A disc-shaped flywheel 95 is coaxial with and rotatably couples to the crankshaft 20.

Each compound cylinder configuration includes one of the cylinder triplets 30 that includes first and second power cylinders 32, 34, respectively, and a third, expander cylinder 36. The first power cylinder 32 houses a first power piston 42 that is slidable therein to translate up and down in conjunction with rotation of the crankshaft 20, and rotatably couples via a first connecting rod 43 and a first multi-link connecting rod assembly 80 to a first crankpin 26 of the crankshaft 20. The first power cylinder 32 defines a first power cylinder center line 33. Similarly, the second power cylinder 34 houses a second power piston 44 that is slidable therein to translate up and down in conjunction with rotation of the crankshaft 20, and rotatably couples via a second connecting rod 45 and a second multi-link connecting rod assembly 180 to a second crankpin 27 of the crankshaft 20 through a second connecting rod 45. The second power cylinder 36 defines a second power cylinder center line 35. The first and second power cylinders 32, 34, first and second power pistons 42, 44, first and second multi-link connecting rod assemblies 80, 180 and associated components are preferably dimensionally equivalent, and the first and second crankpins 26, 27 are radially coincident, i.e., they rotatably couple to the crankshaft 20 at the same rotational angle. In one embodiment, the first and second power cylinder center lines 33, 35 define a plane that intersects with the crankshaft center line 24. Alternatively, and as shown the first and second power cylinder center lines 33, 35 define a plane that is offset from the crankshaft center line 24.

The expander cylinder 36 is adjacent to the first and second power cylinders 32, 34, and has a center line 37 that is parallel to the first and second power cylinder center lines 33, 35. An expander piston 46 is housed in the expander cylinder 36 and is slidable therein to translate up and down in conjunction with rotation of the crankshaft 20, and couples to a third connecting rod 47 that rotatably couples to the crankshaft 20 by a third multi-link connecting rod assembly 50. The expander cylinder 36 is preferably considerably larger in volume than the individual power cylinders 32, 34, and is preferably in a range between 1.5 times and 4.0 times the volumetric displacement of one of the individual power cylinders 32, 34. Cylinder displacement for the expander cylinder 36 is defined based upon piston movement between a top-dead-center (TDC) location and a bottom-dead-center (BDC) location is application-specific and is determined as described herein. Furthermore, the TDC location and the BDC location for the expander cylinder 36 are changeable, as described herein.

The first and second multi-link connecting rod assemblies 80, 180 each form a multi-bar linkage that translates linear reciprocating motion of the corresponding power piston 42, 44 to rotary motion of the crankshaft 20 while minimizing side-loading of the respective power piston 42, 44 against the first and second power cylinder 32, 34. The first and second multi-link connecting rod assemblies 80, 180 each include a rigid main link arm 82, 182 that is a three-pin plate that includes a first pivot pin 83, 183, a second pivot pin 84, 184 and a third pivot pin 85, 185. The first pivot pins 83, 183 of the main link arms 82, 182 rotatably couple to the corresponding first and second connecting rods 43, 45 that couple to the respective first and second power pistons 42, 44. The second pivot pins 84, 184 of the main link arms 82, 182 rotatably couple to the corresponding first and second crankpins 26, 27 of the crankshaft 20. The first and second crankpins 26, 27 of the crankshaft 20 are collocated with the second pivot pins 84, 184 on the respective multi-link connecting rod assembly 80,180 and are rotated 180 degrees from the third crankpin 28. The third pivot pins 85, 185 of the main link arms 82, 182 rotatably couple to a first end of a corresponding first or second swing arm 86, 186, respectively and a second end of the corresponding first or second swing arm 86, 186 rotatably couples to a corresponding fourth pivot pin 87, 187, each which is a rotating anchor point that couples to distal ends of corresponding first and second rotating arms 88, 188 that fixedly attach to a control shaft 59 to rotate therewith. In one embodiment, a controllable variable phasing device (phaser) 90 is employed, and includes a stator portion and a rotor portion. The stator portion fixedly attaches to the control shaft 59 to rotate therewith and the rotor portion controllably attaches to the stator portion. The phaser 90 controls rotational position of the control shaft 59 in relation to a rotational position of the crankshaft 20, and there is preferably 180 degrees of rotational freedom between a rotational position of the stator portion and a rotational position of the rotor portion. The first and second rotating arms 88, 188 extend between a centerline of the control shaft 59 and the corresponding fourth pivot pin 87, 187 that are located on an outer periphery of the rotor portion of the phaser 90 and rotatably couple with the corresponding first or second swing arm 86, 186. The third rotating arm 58 extends between the centerline of the control shaft 59 and the fifth pivot pin 57 that is located on the outer periphery of the rotor portion of the phaser 90 and rotatably couples with the third swing arm 56. Preferably, the third rotating arm 58 is located such that the fifth pivot pin 57 is located at 180 degrees of rotation about the centerline of the control shaft 59 from the fourth pivot pins 87, 187 of the first and second swing arms 86, 186. The phaser 90 controls phasings of the fourth pivot pins 87, 187 and the fifth pivot pin 57 in relation to rotational position of the crankshaft 20. Mechanization and control of phasing devices such as the phaser 90 are known and not described in detail. The control shaft 59 rotatably couples to the crankshaft 20 at a predetermined distance from the crankshaft center line 24 and rotates in concert with the crankshaft 20, including rotating at the same rotation speed and in the same rotational direction as the crankshaft 20 in one embodiment. The phaser 90 is controlled to control rotational positions of the third rotating arm 58 and the first and second swing arms 86, 186 in relation to the rotational position of the crankshaft 20. As shown, the control shaft 59 rotates in the same direction, indicated by element 92, as the direction of rotation of the crankshaft 20, indicated by element 22, in one embodiment. Alternatively the control shaft 59 rotates in the opposite direction as the crankshaft 20.

The third multi-link connecting rod assembly 50 forms a multi-bar linkage that translates linear reciprocating motion of the expander piston 46 offset from the crankshaft center line 24 to rotary motion of the crankshaft 20 while minimizing side-loading of the expander piston 46. An offset 25 between the crankshaft center line 24 and the center line 37 of the expander cylinder 36 is shown with reference to FIG. 4. The multi-link connecting rod assembly 50 includes a rigid main link arm 52 that is a three-pin plate that includes a first pivot pin 53, a second pivot pin 54 and a third pivot pin 55. The first pivot pin 53 of the main link arm 52 rotatably couples to the third connecting rod 47 that couples to the expander piston 46. The second pivot pin 54 of the main link arm 52 rotatably couples to the third crankpin 28 of the crankshaft 20. The third crankpin 28 of the crankshaft 20 is collocated with the second pivot pin 54 on the multi-link connecting rod assembly 50 and is rotated 180 degrees from the first and second crankpins 26, 27. The third pivot pin 55 of the main link arm 52 rotatably couples to a first end of a third swing arm 56, and a second end of the third swing arm 56 rotatably couples to a fifth pivot pin 57, which is a rotating anchor point that couples to a distal end of the third rotating arm 58 that fixedly attaches to the control shaft 59 to rotate therewith. In one embodiment, and as shown the variable phasing device (phaser) 90 is inserted between the third rotating arm 58 and the control shaft 59 and rotatably couples the third rotating arm 58 to the control shaft 59 to effect phasing control of the third rotating arm 58 and the rotating anchor point at the fifth pivot pin 57. Mechanization and control of phasing devices such as the phaser 90 are known and not described in detail. The control shaft 59 rotatably couples to the crankshaft 20 at a predetermined distance from the crankshaft center line 24 and rotates at the same rotation speed, and the phaser 90 is controlled to control rotational phasing of the third rotating arm 58 in relation to rotational position of the crankshaft 20.

In one embodiment, the phasing authority of the phaser 90 is between 0 degrees (Position 1) and 180 degrees of rotation (Position 2). The effect of controlling phasing of the phaser 90 is to control rotational phasing of the first and second rotating arms 88, 188 and the third rotating arm 58 in relation to rotational position of the crankshaft 20. The reciprocating movement of the expander piston 46 is 180 degrees out of phase with the reciprocating movement of the first and second power pistons 42, 44. Thus, when the expander piston 46 is at a TDC point, the first and second power pistons 42, 44 are at BDC points.

The arrangements of the elements of the first, second and third multi-link connecting rod assemblies 50, 80 and 180 affect the strokes of the corresponding first and second power pistons 42, 44 and the expander piston 46 and hence the volumetric displacements and geometric compression ratios thereof. The first, second and third multi-link connecting rod assemblies 50, 80 and 180 mechanically couple the in-cylinder translations of the first and second power pistons 42, 44 with the in-cylinder translation of the expander piston 46 during rotation of the crankshaft 20 through the first, second and third crankpins 26, 27 and 28. In each of the first, second and third multi-link connecting rod assemblies 50, 80, 180, the respective first pivot pin 53, 83, 183 and the respective second pivot pin 54, 84, 184 of the respective rigid main link arm 52, 82, 182 define a first linear distance. The respective second pivot pin 54, 84, 184 and the respective third pivot pin 55, 85, 185 define a second linear distance. This configuration including the respective main link arm 52, 82, 182 permits the stroke of the expander piston 46 to differ from a third crank throw length that is defined by the third crankpin 28 of the crankshaft 20 and also permits the strokes of the first and second power pistons 42, 44 to differ from first and second crank throw lengths that are defined by the first and second crankpins 26 and 27 of the crankshaft 20.

A magnitude of a linear travel distance of the expander piston 46 between a TDC point and a BDC point is determined based upon the lever arm, i.e., a first linear distance and the second linear distance between the pivot pins, the third crank throw, the throw of the rotating anchor arm and fifth pivot pin 57, and the phasing of the third rotating arm 58 with respect to the crankshaft 20 all affect the stroke of the expander piston 46.

A magnitude of a linear travel distance of each of the first and second power pistons 42, 44 between a TDC point and a BDC point is determined based upon the lever arm, i.e., a first linear distance and the second linear distance between the pivot pins, the first and second crank throws, the throw of the rotating anchor arm and respective fourth pivot pin 87, 187, and the phasing of the respective first or second rotating arm 88, 188 with respect to the crankshaft 20 all affect the stroke of the first and second power pistons 42, 44.

As such, when the phaser 90 is controlled to position 1, the expander piston 46 is active and moves between a first top-dead-center (TDC) point 122 and a first bottom-dead-center (BDC) point 120 with each rotation of the crankshaft 20 and has an active piston stroke travel distance 121. When the phaser 90 is controlled to position 2, the expander piston 46 is deactivated and moves between a second TDC point 126 and a second BDC point 125 with each rotation of the crankshaft 20 and has a deactivated piston stroke travel distance 123. The active piston stroke travel distance 121 is substantially greater than the deactivated piston stroke travel distance 123.

Similarly, when the phaser 90 is controlled to position 1, the first and second power pistons 42, 44 operate at low compression ratios by moving between a first top-dead-center (TDC) point 114 and a first bottom-dead-center (BDC) point 110 with each rotation of the crankshaft 20 at a low-compression ratio piston stroke travel distance 113. When the phaser 90 is controlled to position 2, the first and second power pistons 42, 44 are at high compression ratios and move between a second TDC point 112 and a second BDC point that is the same as the first BDC point 110 with each rotation of the crankshaft 20, and have high-compression ratio piston stroke travel distances 111. The low-compression ratio piston stroke travel distance 113 is slightly less than the high-compression ratio piston stroke travel distance 111, and is determined based upon preferred values for the low and high compression ratios.

The cylinder head 60 is an integrated device including cast portions, machined portions and assembled portions for controlling and directing flows of intake air, fuel and combustion gases into and out of the first and second power cylinders 32, 34 and the expander cylinder 36 to effect engine operation to generate mechanical power. The cylinder head 60 includes structural bearing supports for power cylinder camshaft(s) and expander camshaft(s). The cylinder head 60 includes first and second power cylinder intake runners 70, 74, respectively, which fluidly connect to first and second power cylinder intake ports 71, 75, respectively, with engine intake airflow controlled by first and second power cylinder intake valves 62, 64, respectively. As shown, there are two intake valves per cylinder, although any suitable quantity, e.g., one or three intake valves per cylinder, may be employed. Engine intake air originates from an ambient air source, which may pass through a pressurizing device such as a turbocharger or a supercharger prior to entering the first and second power cylinder intake runners 70, 74. The cylinder head 60 also includes first and second power cylinder exhaust ports 72, 76, with engine exhaust airflow controlled by first and second power cylinder exhaust valves 63, 65, respectively. As shown, there are two exhaust valves per cylinder, although any suitable quantity, e.g., one or three exhaust valves per cylinder, may be employed. The first and second power cylinder intake valves 62, 64 and exhaust valves 63, 65 are normally-closed spring-biased poppet valves that are activated by rotation of the power cylinder camshafts in one embodiment, and may alternatively include any other suitable valve and valve activation configuration.

The cylinder head 60 supports elements necessary to initiate combustion, e.g., a spark plug and a fuel injector in one embodiment, for each of the first and second power cylinders 32, 34. The first power cylinder exhaust port 72 fluidly couples via a first expander cylinder intake runner 73 to a first expander cylinder intake port 79, with flow controlled by a first expander cylinder intake valve 66 and the first power cylinder exhaust valve 63. The second power cylinder exhaust port 76 fluidly couples via a second expander cylinder intake runner 77 to a second expander cylinder intake port 98, with flow controlled by a second expander cylinder intake valve 67 and the second power cylinder exhaust valve 65. The cylinder head 60 also includes one or a plurality of expander cylinder exhaust port(s) 78, two of which are shown, with corresponding expander cylinder exhaust valve(s) 68 that fluidly connect to an expander cylinder exhaust runner 96 that leads to an exhaust system that may include exhaust purification devices, a turbocharger, exhaust sound tuning devices, etc. The first expander cylinder intake valve 66, the second expander cylinder intake valve 67 and the expander cylinder exhaust valve(s) 68 may be normally-closed spring-biased poppet valves that may be activated by rotation of the expander camshaft in one embodiment, and may alternatively include any other suitable camshaft configuration. The rotations of the power cylinder camshafts and the expander camshafts are preferably indexed and linked to rotation of the crankshaft 20. The first and second crankpins 26, 27 of the crankshaft 20 rotatably couple with the first and second power pistons 42, 44 through the first and second connecting rods 43, 45.

Operation of the engine 10 described herein includes as follows. The first and second power cylinders 32, 34 both operate in four-stroke cycles including repetitively executed intake-compression-expansion-exhaust strokes over 720 degrees of crankshaft rotation. The four-stroke cycle associated with the second power cylinder 34 is out of phase from the cycle associated with the first power cylinder 32 by 360 degrees of crankshaft rotation. As such, when the first power cylinder 32 is in the intake stroke, the second power cylinder 34 is in the expansion stroke, and when the second power cylinder 34 is in the intake stroke, the first power cylinder 32 is in the expansion stroke. The expander cylinder 36 operates in a two-stroke cycle including an intake stroke and an exhaust stroke, wherein the intake stroke is alternately coordinated with the exhaust strokes from the first and second power cylinders 32, 34. As such, each of the power cylinders 32, 34 displaces its exhaust gas into the expander cylinder 36 in alternating fashion.

Figure 5:
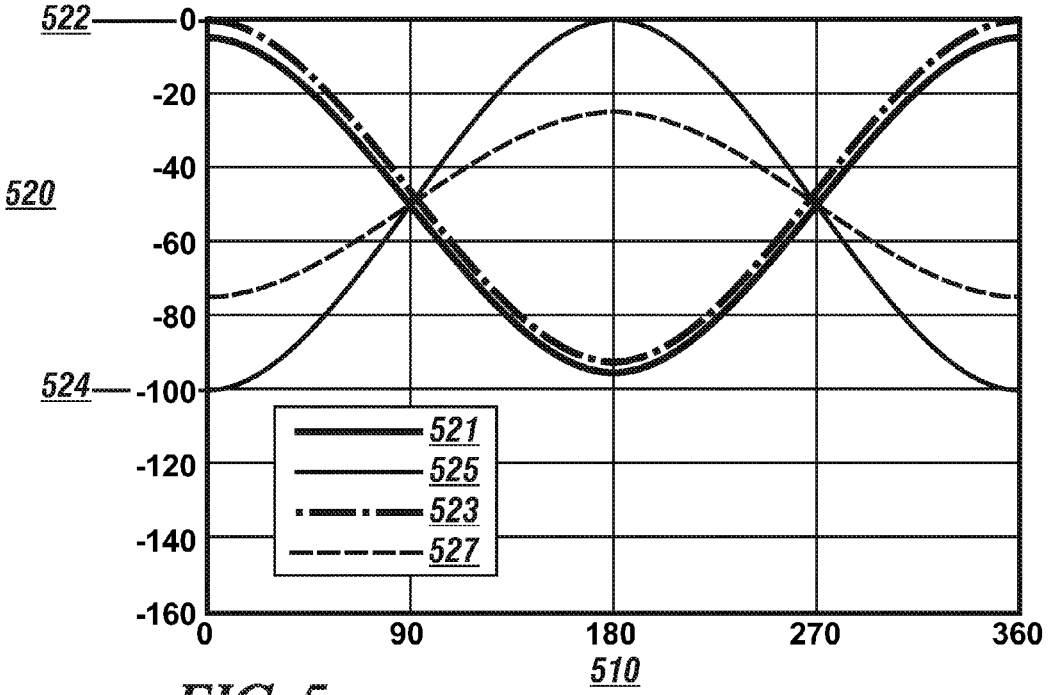
FIG. 5 graphically shows positions of an expander piston and one of the power pistons over 360 degrees of crankshaft rotation for an embodiment of the single-shaft dual expansion internal combustion engine described herein, in accordance with the disclosure.

FIG. 5 graphically shows positions of an expander piston and one of the power pistons over 360 degrees of crankshaft rotation for an embodiment of the single-shaft dual expansion internal combustion engine 10 described herein, with piston position 520 shown on the vertical axis in relation to crankshaft rotation 510 shown on the horizontal axis. The piston positions 520 are depicted in relation to TDC and BDC, wherein TDC point 522 and BDC point 524 reflect the piston positions in the high load state with the expander piston in an active state, i.e., under high load conditions. Plotted results show the power piston at a high load condition 521, the power piston at a low load condition 523, the expander piston at the high load condition 525, and the expander piston at the low load condition 527.

The piston configuration described herein permits the expander cylinder 36 and associated expander piston 46 to be significantly offset from the crankshaft center line 24 without operating issues associated with piston side loading. This allows the stroke of the expander piston 46 to be selected in relation to the crank throw, but does not limit the stroke to be equivalent to the crank throw. Such configurations allows for more compact design of an embodiment of the single-shaft dual expansion internal combustion engine 10, including an overall shorter engine length, a shorter engine height, and better engine performance through lower gas transfer losses due to the minimization of the lengths of the intake runners 73, 77 for the expander cylinder 36. The change in stroke that is used to de-activate the expander piston 46 reduces friction when it is not in use. The stroke change is also used to vary the compression ratio in the power cylinders 32, 34 in relation to speed and load. Furthermore, the compression ratios of the power cylinders 32, 34 are reducible at high load conditions to reduce cylinder pressure with corresponding reduction in peak firing pressure and improvement in airflow. The compression ratios of the power cylinders 32, 34 are increasable at low load conditions to improve efficiency.

While the best modes for carrying out the many aspects of the present teachings have been described in detail, those familiar with the art to which these teachings relate will recognize various alternative aspects for practicing the present teachings that are within the scope of the appended claims.

The invention claimed is:

1. A single-shaft dual expansion internal combustion engine, comprising:

an engine block, a cylinder head, a single crankshaft, a control shaft and first, second and third multi-link connecting rod assemblies;

first and second power cylinders and an expander cylinder being formed in the engine block;

first and second power pistons being moveable in the first and second power cylinders, respectively, and being connected via the respective first and second multi-link connecting rod assemblies to respective first and second crankpins of the crankshaft;

an expander piston being moveable in the expander cylinder and being connected via the third multi-link connecting rod assembly to a third crankpin of the crankshaft; and the first and second multi-link connecting rod assemblies being coupled to fourth pivot pins of respective first and second swing arms that are attached to the control shaft, and the third multi-link connecting rod assembly being attached to a fifth pivot pin of a third swing arm that is attached to the control shaft;

wherein the third swing arm attaches to the control shaft at a position that is rotated 180 degrees about a rotational axis of the control shaft from an attaching location of the first and second swing arms.

2. The single-shaft dual expansion internal combustion engine of claim 1, wherein the control shaft rotates in concert with rotation of the crankshaft.

3. The single-shaft dual expansion internal combustion engine of claim 1, wherein the control shaft rotates at the same rotational speed as rotation of the crankshaft.

4. The single-shaft dual expansion internal combustion engine of claim 1, further comprising a phaser coupled to the control shaft, wherein the phaser includes a stator portion fixedly attached to the control shaft and a rotor portion rotatably attached to the stator, wherein the phaser controls rotational position of the control shaft in relation to a rotational position of the crankshaft.

5. The single-shaft dual expansion internal combustion engine of claim 4, wherein the first and second power pistons operate at a first compression ratio when the phaser controls rotational position of the control shaft to a first position in relation to rotational position of the crankshaft.

6. The single-shaft dual expansion internal combustion engine of claim 5, wherein the expander piston operates in a deactivated state when the phaser controls rotational position of the control shaft to the first position in relation to rotational position of the crankshaft.

7. The single-shaft dual expansion internal combustion engine of claim 6, wherein the power cylinders operate at a high compression ratio and the expander cylinder is deactivated when the phaser controls rotational position of the control shaft to the first position.

8. The single-shaft dual expansion internal combustion engine of claim 7, wherein the phaser controls rotational position of the control shaft to the first position in response to a low engine load condition.

9. The single-shaft dual expansion internal combustion engine of claim 5, wherein the first and second power pistons operate at a second compression ratio less than the first compression ratio when the phaser controls rotational position of the control shaft to a second position in relation to rotational position of the crankshaft, wherein the second position is 180 degrees of rotation from the first position of the control shaft.

10. The single-shaft dual expansion internal combustion engine of claim 9, wherein the expander piston operates in an activated state when the phaser controls rotational position of the control shaft to a second position in relation to rotational position of the crankshaft, wherein the second position is 180 degrees of rotation from the first position of the control shaft.

11. The single-shaft dual expansion internal combustion engine of claim 10, wherein the power cylinders operate at a low compression ratio and the expander cylinder is activated when the phaser controls rotational position of the control shaft to the second position.

12. The single-shaft dual expansion internal combustion engine of claim 11, wherein the phaser controls rotational position of the control shaft to the second position in response to a high engine load condition.

13. The single-shaft dual expansion internal combustion engine of claim 1, wherein the third crankpin of the crankshaft is 180 degrees out of phase with first and second crankpins.

14. The single-shaft dual expansion internal combustion engine of claim 1, wherein each of the first, second and third multi-link connecting rod assemblies includes a rigid main arm extending orthogonally to a longitudinal axis of the crankshaft and supporting a first pivot pin located on a first end of the main arm, a second pivot pin located on a central portion of the main arm and a third pivot pin located on a second end of the main arm;

the first pivot pin being coupled via a connecting rod to a respective one of the first, second or third piston;

the second pivot pin being coupled to a respective first, second or third crankpin of the crankshaft;

the third crankpin having a throw that is rotated 180 degrees around the longitudinal axis of the crankshaft from respective throws of the first and second crankpins; and the third pivot pin coupled to a first end of a swing arm, and a second end of the swing arm rotatably coupled to a fourth pivot pin that couples to a distal end of a rotating arm that attaches to the control shaft.

15. The single-shaft dual expansion internal combustion engine of claim 1, wherein the cylinder head fluidly couples the first and second power cylinders and the expander cylinder.

16. The single-shaft dual expansion internal combustion engine of claim 15, wherein the cylinder head comprises a first exhaust port, a first exhaust runner and a first expander cylinder intake port fluidly connecting the first power cylinder to the expander cylinder and a second exhaust port, a second exhaust runner and a second expander cylinder intake port fluidly connecting the second power cylinder to the expander cylinder.

17. The single-shaft dual expansion internal combustion engine of claim 1, wherein the first power cylinder operates in a four-stroke combustion cycle and the second power cylinder operates in a four-stroke combustion cycle.

18. The single-shaft dual expansion internal combustion engine of claim 17, wherein the four-stroke combustion cycle of the first power stroke executes 360 degrees of rotation out of phase with the four-stroke combustion cycle of the second power cylinder.

19. A method for controlling a single-shaft dual expansion internal combustion engine including first and second power pistons and an expander piston that are coupled via multi-link connecting rod assemblies to a crankshaft, and a control shaft including a phaser having rotating arms that rotatably coupled via swing arms to the multi-link connecting rod assemblies, wherein one of the swing arms that couples via one of the multi-link connecting rod assemblies to the expander piston attaches to the control shaft at a position that is rotated 180 degrees about a rotational axis of the control shaft from an attaching location of the swing arms that couple via ones of the multi-link connecting rod assemblies to the first and second power pistons, the method comprising:

controlling the phaser to a first position in relation to a rotational position of the crankshaft to operate the first and second power pistons at a first compression ratio in response to a low engine load condition; and controlling the phaser to a second position in relation to the rotational position of the crankshaft to operate the first and second power pistons at a second, compression ratio in response to a high engine load condition;

wherein the second compression ratio is less than the first compression ratio.

20. The method of claim 19, wherein there is 180 degrees of rotation between controlling the phaser to the first position and controlling the phaser to the second position.

* * * * *